US007287815B2

(12) United States Patent
Leguen et al.

(10) Patent No.: US 7,287,815 B2
(45) Date of Patent: Oct. 30, 2007

(54) ERGONOMIC SEATING MODULE AND SEAT FITTED WITH SAID MODULE

(76) Inventors: André Leguen, Ergopole, Route d'Elna, Montescot (FR); Catherine Cantenot, Ergopole, Route d'Elna, Montescot (FR)

( * ) Notice: Subject to any disclaimer, the term of this patent is extended or adjusted under 35 U.S.C. 154(b) by 0 days.

(21) Appl. No.: 10/510,456

(22) PCT Filed: Mar. 14, 2003

(86) PCT No.: PCT/IB03/01899

§ 371 (c)(1),
(2), (4) Date: Oct. 4, 2004

(87) PCT Pub. No.: WO03/082057

PCT Pub. Date: Oct. 9, 2003

(65) Prior Publication Data

US 2005/0116527 A1 Jun. 2, 2005

(30) Foreign Application Priority Data

Apr. 2, 2002 (EP) ..... 02405251

(51) Int. Cl.
*A47C 7/14* (2006.01)
*A47C 7/50* (2006.01)
*A47C 1/00* (2006.01)

(52) U.S. Cl. ..... 297/423.12; 297/313; 297/423.11; 297/452.25; 297/452.56; 297/452.63; 297/452.64; 297/487; 297/488

(58) Field of Classification Search ..... 297/423.12, 297/452.56, 423.11, 313, 337, 344.1, 452.63, 297/452.64, 452.25, 487, 488
See application file for complete search history.

(56) References Cited

U.S. PATENT DOCUMENTS

| | | | | | |
|---|---|---|---|---|---|
| 4,552,404 | A * | 11/1985 | Congleton | ..... | 297/452.25 X |
| 4,767,160 | A * | 8/1988 | Mengshoel et al. | .... | 297/423.12 |
| 5,255,957 | A | 10/1993 | Opsvik et al. | ..... | 297/423.12 |
| 5,542,746 | A * | 8/1996 | Bujaryn | ..... | 297/423.12 |
| 5,669,669 | A * | 9/1997 | Usher | ..... | 297/423.12 |
| 5,857,747 | A * | 1/1999 | Mundkowski | ..... | 297/423.11 |
| 6,113,186 | A * | 9/2000 | Holmes et al. | ..... | 297/248 |
| 6,231,125 | B1 * | 5/2001 | Maeda et al. | ..... | 297/452.56 |
| 6,293,625 | B1 | 9/2001 | Dixon | ..... | 297/452.25 |

FOREIGN PATENT DOCUMENTS

| | | |
|---|---|---|
| DE | 39 91 487 C | 4/1994 |
| DE | 100 09 264 A | 9/2001 |
| GB | 2176396 | 12/1986 |

* cited by examiner

*Primary Examiner*—Rodney B. White
*Assistant Examiner*—Stephen Vu
(74) *Attorney, Agent, or Firm*—Townsend M. Belser, Jr.; Nexsen Pruet Adams Kleemeier, LLC

(57) ABSTRACT

The incentive seating module comprises: a structural frame provided with a gaiter, a frame, disposed above said structural frame and provided with an arch, whereby the structural frame exhibits planar symmetry, means for connecting the frame to the structural frame comprising a joint enabling the frame to swivel in relation to the structural frame about an axis which is perpendicular to the symmetrical plane, and a seating element joining the frame to the gaiter, made of an elastic membrane which is used to define a rest position for the frame in relation to the structural frame and to return it towards said position when a user causes it to tilt in one direction or the other.

20 Claims, 3 Drawing Sheets

ERGONOMIC SEATING MODULE AND SEAT FITTED WITH SAID MODULE

BACKGROUND OF THE INVENTION

1) Field of the Invention

The present invention relates to seats, both those intended to be static, such as chairs, armchairs or stools, and those to be fitted to vehicles. It concerns, more particularly, both an ergonomic seating module and a chair fitted with said module.

2) Description of Related Art

It should be understood that, for the purpose of simplification, the expression "seating module" will be sometimes replaced, in this document, by the word "seat", designating the part of the chair forming the actual seat on which the buttocks are placed.

In static chairs, the seat is generally formed of a plate made of rigid material, which may be covered with a cushion. This seat may be completed by a back and by armrests. Certain chairs, more particularly intended for persons working in offices, for example, with a computer, include joints and elastic members for inclining more or less the seat and the back. Despite all the improvements made, health problems, especially relating to the vertebral column, continue to exist, causing great injury to those who suffer therefrom and resulting in significant absenteeism, which is detrimental to businesses.

Bicycle or moped saddles, for example, generally include a rigid frame, including a pommel element and a cantle element, and a part, generally of triangular shape connecting the pommel element to the cantle element and forming the support surface. This part has a certain flexibility allowing adaptation to the position of the user, defined by adjusting various parts of the vehicle. Saddles of this type have been arranged on fixed supports, in order to make static chairs. If, in general, the comfort of a bicycle saddle is not disputed, the application of the same principle to a fixed chair is unconvincing. This is probably due to the fact that, in a static situation, the user's limbs, in contact with the seat, remain fixed, whereas on a bicycle, they are in almost permanent movement.

In order to properly understand the problem of chairs, it is helpful to recall the use that is made thereof. Today, the seated position has become one of the most representative of professional activity. Within this scope, two sorts of quite distinct attitude generally occur, depending upon whether the occupation is "active" or "passive". An "active" occupation means one in which the hands are used a great deal, for example for typing on a keyboard, drawing, any seated manual work (watchmaking, electronics, laboratory, clothing industry, . . . ) or driving a vehicle. The body thus has to be placed such that the hands can carry out their function. It is generally positioned with the trunk oriented substantially vertically. Conversely, in "passive" occupations, such as discussions, moments of reflection or relaxation, the hands are much less used and the body can be placed such that the back is resting against a backrest, the trunk inclined backwards.

Designers of chairs for seated work make them so as to prevent any stress on the musculature. If this approach is proper during phases of "passive" occupation, which allow the body to rest, it is detrimental to the organism in phases of "active" occupation. Indeed, it appears that what, at the start, is perceived as additional comfort, leads to a weakening of the supporting muscles, which can cause numerous annoyances, lumbar pains being the most frequent.

Experience seems to show that the health problems, encountered by people working in a seated position, could arise from a weakening of the supporting musculature. This musculature does not directly participate in the person's mobility, but allows him to ensure a position of balance, both when the person is standing, stopped or moving, and when the person is sitting or squatting. It can only develop or be maintained harmoniously if it is regularly used, while preventing crispation of one muscle or another.

It is an object of the present invention to provide a chair fitted with an ergonomic seat which practically forces the user to adopt a posture in which his supporting musculature is used naturally and automatically, thus preventing health problems.

More specifically, the invention concerns a seating module, which includes:

- a structural framework provided with a pommel element,
- a frame provided with a cantle element, said structural framework and said frame having planar symmetry,
- means for connecting the structural framework to the frame, including a joint which allows the frame to tilt, in relation to the structural framework, about an axis perpendicular to the plane of symmetry, and
- a seat connecting the frame to the pommel element and formed of an elastic membrane whose function is to define a rest position of the frame in relation to the structural framework and to return it to this position when a user tilts it in one direction or another.

The seating module according to the invention further includes the following main features:

- in the rest position, the frame is inclined forwards by an angle of approximately 10° in relation to the ground;
- the structural framework has, in plane, a T-shape, the vertical bar of which, arranged in the plane of symmetry, extends forwards and is bent upwards to end in the pommel element;
- the ends of the horizontal bars of the T are raised to form the joint with the structural framework;
- the frame is a fork which, in plane, has a U-shape with an axis disposed in the plane of symmetry, the cross bar of which is raised and forms the cantle element and the two vertical bars of which extend forwards, substantially as far as the pommel element, which is underneath it;
- the membrane forms a support surface that is convex along a line perpendicular to the plane of symmetry and concave along a line inscribed in this plane;
- the membrane is fixed between the pommel element and the cantle element, between the two teeth of the fork, and between the ends of the teeth and the pommel element;
- the membrane is covered by a padding member forming a cushion and includes a longitudinal groove intended to form a space for receiving the user's coccyx.

The present invention also concerns a chair provided with a support in contact with the ground and a seating module as defined hereinbefore, characterized in that the support includes an arm extending forwards and upwards and carrying a cross bar forming a support for the user's knees and padded to form a cushion.

BRIEF DESCRIPTION OF THE DRAWINGS

Other features of the invention will appear from the following description, made with reference to the annexed drawing, in which.

DETAILED DESCRIPTION OF THE INVENTION

Figure 1:
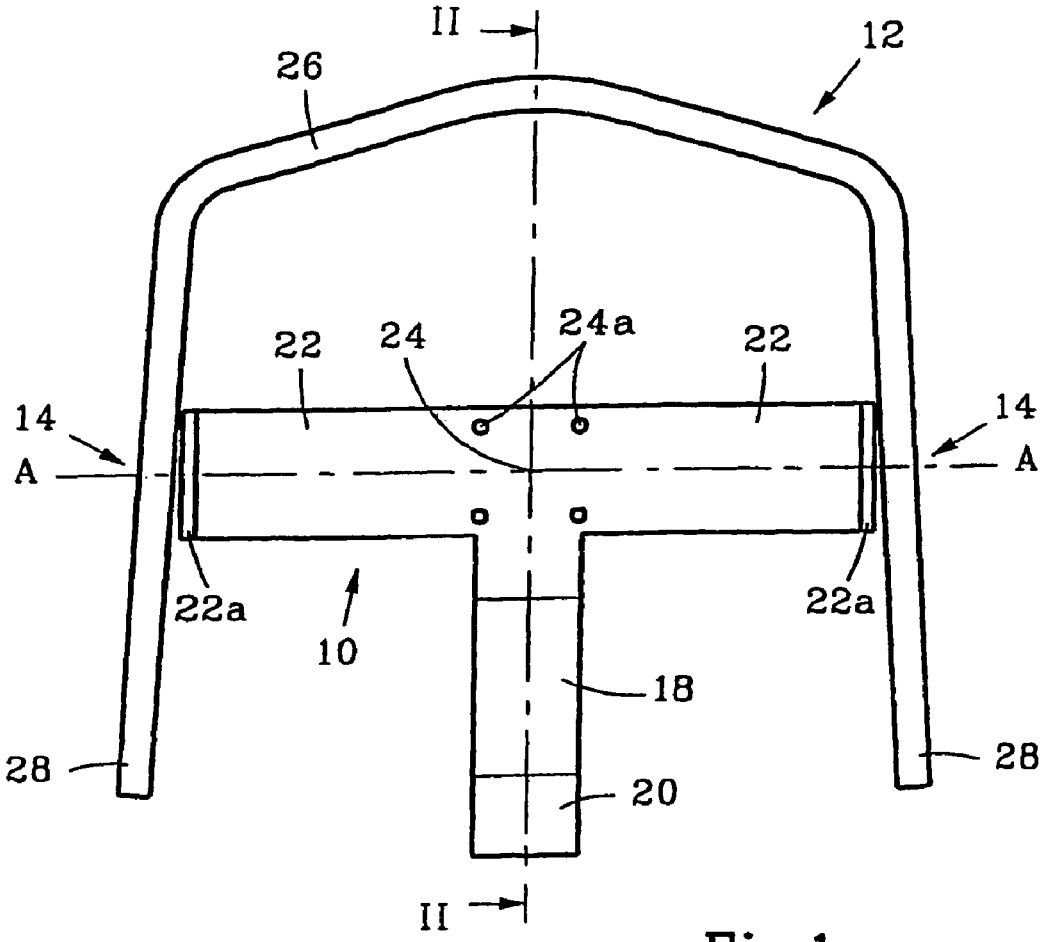
FIGS. 1 and 2 show the structural framework and the fork of a seating module according to the invention, respectively seen from the top and in cross-section along the line II-II of FIG. 1.
Figure 2:
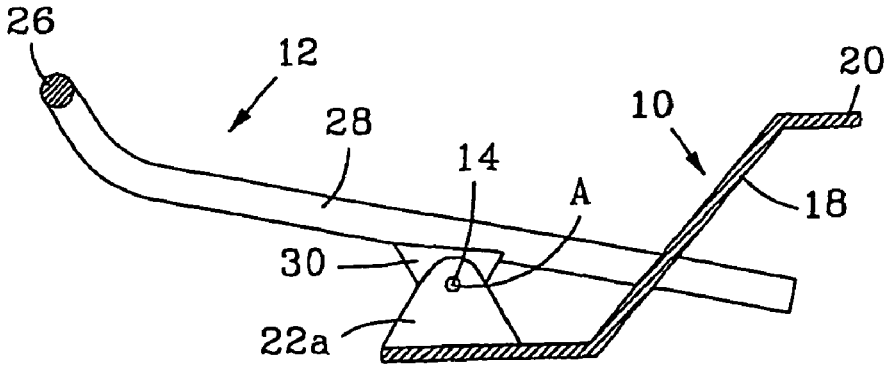
Figure 3:
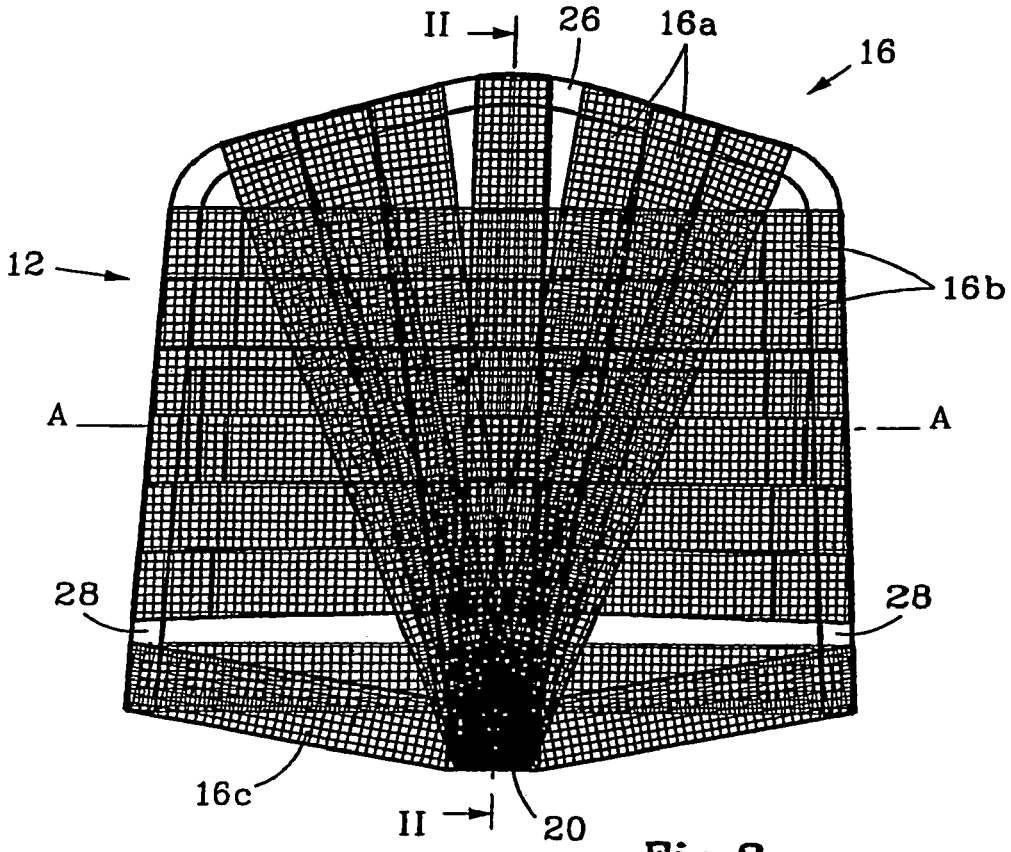
FIG. 3 shows mainly the fork, seen from the top, provided with its elastic membrane.
Figure 4:
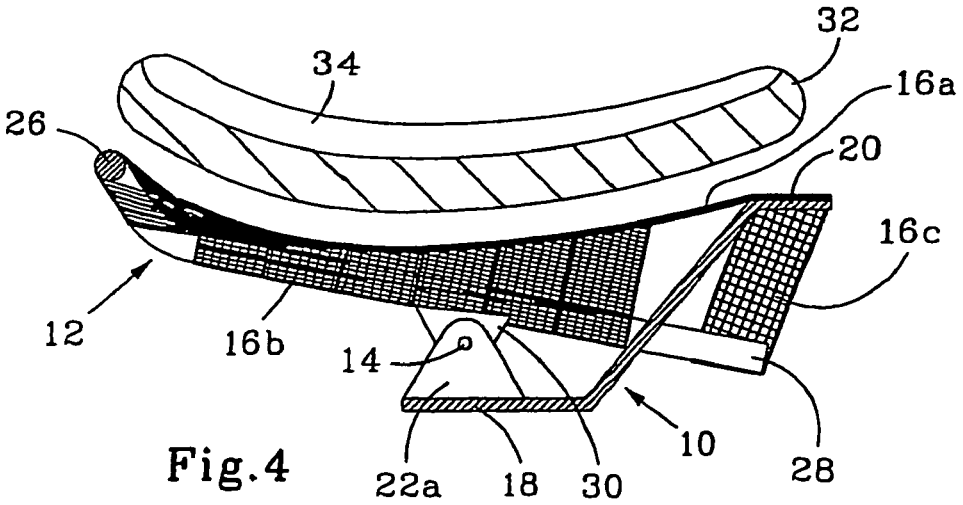
FIG. 4 is a cross-section of the seating module, again along II-II.

The seating module—or seat—according to the invention essentially includes a structural framework 10, a fork-shaped frame 12, a hinge 14 connecting, in a jointed manner, structural framework 10 and fork 12, and an elastic membrane 16, visible only in FIGS. 3 and 4. The seat has a symmetrical structure with reference to a vertical plane passing through lines II-II of FIGS. 1 and 3.

More specifically, structural framework 10, in plane, has a T-shape the vertical bar 18 of which, placed in axis II-II, extends forwards and is bent upwards to end in a pommel element 20. The ends 22*a* of arms 22 of the T, perpendicular to the axis, are raised and pierced with a hole that is not visible in the drawing. Structural framework 10 has a central portion 24 provided with holes 24*a* allowing the seat to be fixed onto a support, as will be explained hereinafter.

In plane, fork 12 has a U-shape of axis II-II. Its cross bar 26, which is slightly raised and bent, acts as cantle element and its two teeth 28 extend forwards substantially as far as pommel element 20, a few centimeters underneath it.

It will be noted that, in the seat rest position, shown in the drawing, the tip of cantle element 26 is located at substantially the same height as pommel element 20, and that fork 12 is inclined forwards by an angle of approximately 10° in relation to the ground.

Teeth 28 of the fork are provided, substantially in their middle, with a lug 30*a* extending downward, each adjacent to one end 22*a* of the structural framework and provided with a coaxial hole. Bearings engaged in these holes and rods, engaged in the bearings, form hinge 14, which thus enables fork 12 to be pivoted in relation to structural framework 10 about an axis A-A.

Advantageously, structural framework 10 and fork 12 are respectively made of aluminum and steel.

FIG. 3 shows that elastic membrane 16 is fixed:

firstly, between pommel element 20 and cantle element 26;

secondly, between the two teeth 28 of fork 12; and thirdly, between the ends of teeth 28 and pommel element 20.

Membrane 16 can be made of any elastic material, for example PVC, in the form of a fabric, as shown in FIGS. 3 and 4, or film, in one piece or in strips. In the latter case, a first set of strips 16*a* connects pommel element 20 to cantle element 26, a second set 16*b* connects the two teeth 28 to each other, this second set covering the first, and a third set 16*c* connects the ends of teeth 28 to pommel element 20.

Because of the shape of fork 12 and the position of pommel element 20, membrane 16 has a horse-saddle shape, with a concavity between cantle element 26 and pommel element 20 and a convexity between the two teeth 28. Owing to these features, the function of membrane 16 is to:

define the rest position of fork 12 in relation to structural framework 10, the position taken when no-one is sitting on the seat, and return fork 12 to this rest position when the person who has tilted the seat forwards or backwards leaves it.

As can be seen in FIG. 4, the seat according to the invention can advantageously be completed by a padding member 32, forming a cushion, totally covering membrane 16 and permanently or removably fixed to the latter. This padding member can be formed by a fabric envelope containing an elastic filling or formed of a gel. Advantageously, it is provided with a longitudinal groove 34 extending over the entire length of the cushion. Consequently, the coccyx of the person occupying the seat is not compressed, which improves comfort and prevents certain damage, particularly as regards the vertebral column.

Figure 5:
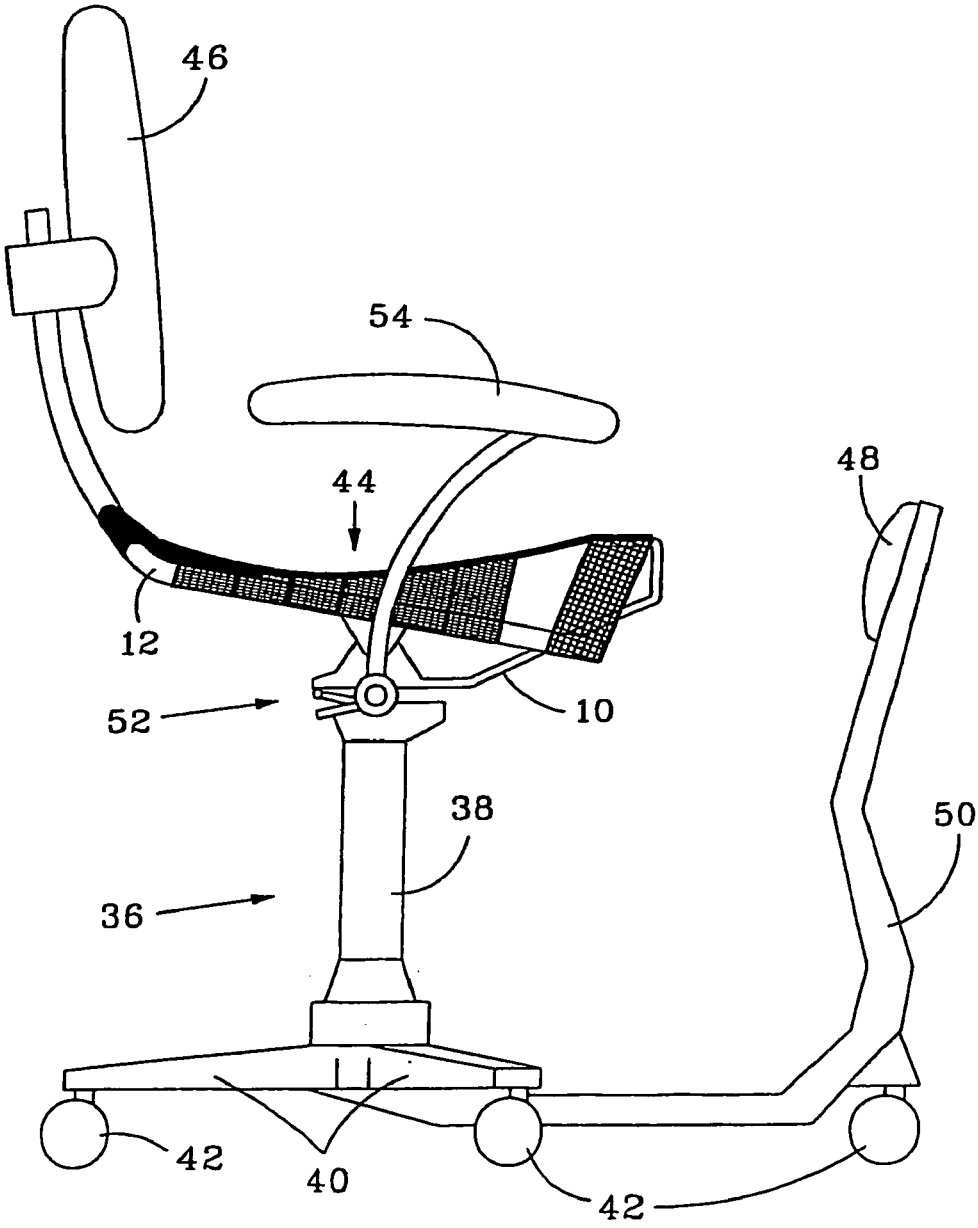
FIG. 5 shows a chair according to the invention.

FIG. 5 shows that the seating module previously described is for fitting to a chair formed of a support 36, which includes, in a known manner, a telescopic central column 38 and feet 40 disposed radially, each provided with a roller 42. Column 38 has, at its top end, a seating module 44 according to the invention, which is fixed by its structural framework 10.

Such a chair, thus forming a stool, can advantageously be used by people essentially working in an "active" position, for example a dentist or a watchmaker. It can be completed, as shown in this Figure, by a backrest 46 fixed to cantle element 26 and allowing a "passive" position to be taken.

When the user frequently works in the "active" position, it is advantageous to provide the chair with a transverse support bar 48 for the knees, advantageously padded and covered with a fabric or leather, so that contact is comfortable. This bar is fixed to support 36, permanently or removably, by means of an arm 50. The latter has a roller 42 and is advantageously connected to support 36 so as to pivot or slide, so that it can be removed when the user often has to leave his chair.

It should be stressed that the pressure of the knees against bar 46 is slight. The latter thus barely participates in the seating of the user. However, it prevents him crossing his legs, and thus, certain annoyances associated with this habit.

As can be seen in FIG. 5, arm 50 is fixed to support 36 in proximity to feet 40, i.e. very close to the ground. Consequently, it does not interfere, or barely interferes, with movement when the user occupies his chair or leaves it.

Finally, in a very advantageous manner, seating module 44 can be jointed on column 38 owing to a conventional adjustable chair tilting mechanism 52 provided with an armrest 54.

Owing to the construction described, when the user sits down to get into the "active" position, he finds seat 44 automatically placed in the rest position corresponding to maximum comfort, i.e. with the femoral articulation at right angles to joint 14.

If the user leans forwards, fork 12 accompanies his movement, allowing him to adjust his posture in a self-supporting process, which contributes to reinforcing the supporting musculature and thus tends to reduce the risk of health problems, as mentioned hereinbefore.

When, in order to think or make a telephone call, the user gets into a "passive" position against backrest 46, fork 12 tilt backwards, such that he finds himself in a posture in which his entire musculature is resting. This automatic adjustment provides optimum comfort due to the fact that the user's weight is distributed very uniformly over the buttocks and the back of the thighs.

In other words, in the "active" position, the chair according to the invention allows adjustments in posture facilitating the work of the self-supporting muscles, whereas in the "passive" position, these muscles can relax.

Both the seating module and the chairs described hereinbefore can be subject to numerous variants. It is, for example, possible to provide adjusting members, and more particularly, stops (not shown) limiting, on both sides, the tilting movement of fork 12 on structural framework 10. Pommel element 20 can also be provided with means for altering its position with reference to structural framework 10. An asymmetrical structure can also be envisaged, for a handicapped user, either at padding member 32, or in the form of cantle element 26.

The hinged connection, via hinge 14, between structural framework 10 and fork 12, can be achieved by means of a ball joint. In this case, the self-supporting mechanism would operate both from front to back and from the side.

The position of hinge 14 can also advantageously be adjustable in the forward-backward direction, such that it is perfectly aligned on the ischium when the user is seated.

Other adjusting means are possible for varying the distance between pommel element 20 and cantle element 26, in order to adjust the tension of elastic membrane 16.

Seat 44 is advantageously fixed to support 36 by its structural framework 10. It is also possible to envisage fixing via cantle element 26 itself.

The spring function performed by elastic membrane 16 can also be reinforced by springs especially arranged for this purpose, for example, torsion, traction or compression springs.

It will be noted, finally, that it may be advantageous to provide backrest 46 with an independent permanent contact lumbar support zone that can be disconnected.

The invention claimed is:

1. A seating module for a chair, comprising:

a structural framework provided with an integrally formed, rigidly attached pommel element, a frame arranged above the structural framework and provided with a cantle element, said structural framework and said frame having planar symmetry, means for connecting the frame to the structural framework, including a joint which allows the frame to tilt, in relation to the structural framework, about an axis perpendicular to the plane of symmetry, and a seat connecting the frame to the pommel element and formed of an elastic membrane whose function is to define a rest position of the frame in relation to the structural framework and to return the frame to this position when a user tilts the frame in one direction or another.

2. The seating module according to claim 1, wherein in the rest position, the frame is inclined forward by an angle of approximately 10° in relation to the ground.

3. The seating module according to claim 2, wherein said membrane is covered with a padding member forming a cushion.

4. A chair fitted with a support in contact with the ground and the seating module according to claim 2 and fixed to said support, wherein said support includes an arm extending forward and upward and carrying a transverse bar forming a support for the user's knees.

5. The seating module according to claim 1, wherein, in plane, the structural framework has a T-shape, the vertical bar of which, arranged in the plane of symmetry, extends forward and is bent upward to end in said pommel element.

6. The seating module according to claim 5, wherein said membrane is covered with a padding member forming a cushion.

7. A chair fitted with a support in contact with the ground and the seating module according to claim 5 and fixed to said support, wherein said support includes an arm.

8. The seating module according to claim 5, wherein said T-shape structural framework comprises a horizontal bar having opposing ends which are raised to form said joint with the structural framework.

9. The seating module according to claim 8, wherein said membrane is covered with a padding member forming a cushion.

10. A chair fitted with a support in contact with the ground and the seating module according to claim 8 and fixed to said support, wherein said support includes an arm extending forward and upward and carrying a transverse bar forming a support for the user's knees.

11. The seating module according to claim 1, wherein the frame comprises: a fork, which has, in plane, the shape of a U with an axis disposed in the plane of symmetry; a raised cross bar forming said cantle element; and two teeth extending forward from said cantle elements, substantially as far as the pommel element, underneath said fork.

12. The seating module according to claim 11, wherein said membrane is covered with a padding member forming a cushion.

13. A chair fitted with a support in contact with the ground and the seating module according to claim 11 and fixed to said support, wherein said support includes an arm extending forward and upward and carrying a transverse bar forming a support for the user's knees.

14. The seating module according to claim 11, wherein said membrane forms a support surface that is convex along a line perpendicular to the plane of symmetry and concave along a line inscribed in said plane.

15. The seating module according to claim 14, wherein said membrane is covered with a padding member forming a cushion.

16. The seating module according to claim 14, wherein said membrane is fixed:

between the pommel element and the cantle element, between the two teeth of the fork, and between said teeth and the pommel element.

17. The seating module according to claim 16, wherein said membrane is covered with a padding member forming a cushion.

18. The seating module according to claim 1, wherein said membrane is covered with a padding member forming a cushion.

19. The seating module according to claim 8, wherein said padding member includes a longitudinal groove for forming a space to receive the user's coccyx.

20. A chair fitted with a support in contact with the ground and a the seating module according to claim 1 and fixed to said support, wherein said support includes an arm extending forward and upward and carrying a transverse bar forming a support for the user's knees.

* * * * *